US006398586B1

(12) United States Patent
Muzslay

(10) Patent No.: US 6,398,586 B1
(45) Date of Patent: Jun. 4, 2002

(54) ARMORED CABLE CONNECTOR

(75) Inventor: Steven Zoltan Muzslay, Huntington Beach, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/847,826

(22) Filed: May 1, 2001

(51) Int. Cl.[7] ..... H01R 13/56

(52) U.S. Cl. ..... 439/606; 439/660; 439/445; 439/192

(58) Field of Search ..... 439/606, 192, 439/321, 445, 446, 447, 448, 473, 660

(56) References Cited

U.S. PATENT DOCUMENTS

| | | | | | |
|---|---|---|---|---|---|
| 2,319,537 | A | * | 5/1943 | Delmonte | 439/660 |
| 2,890,434 | A | | 6/1959 | Ray et al. | |
| 3,971,614 | A | | 7/1976 | Paoli et al. | |
| 4,030,798 | A | | 6/1977 | Paoli | |
| 4,152,039 | A | | 5/1979 | Shah | |
| 4,359,254 | A | | 11/1982 | Gallusser et al. | |
| 4,472,013 | A | | 9/1984 | Frear | |
| 4,548,458 | A | | 10/1985 | Gallusser et al. | |
| 4,622,198 | A | | 11/1986 | Gallusser et al. | 264/318 |
| 4,641,811 | A | | 2/1987 | Gallusser et al. | 249/122 |
| 4,703,988 | A | | 11/1987 | Raux et al. | 439/321 |
| 4,808,117 | A | | 2/1989 | Gale et al. | 439/192 |
| 5,145,394 | A | | 9/1992 | Hager | 439/321 |
| 5,380,224 | A | * | 1/1995 | DiCicco | 439/447 |
| 5,435,760 | A | | 7/1995 | Miklos | 439/321 |
| 6,017,242 | A | * | 1/2000 | Kerrigan | 439/445 |
| 6,135,800 | A | | 10/2000 | Majors | 439/321 |
| 6,220,888 | B1 | * | 4/2001 | Correa | 439/445 |

* cited by examiner

*Primary Examiner*—Tho D. Ta
(74) *Attorney, Agent, or Firm*—Roger C. Turner

(57) ABSTRACT

A combination of a connector (12) and an armored cable (14), where several inches of the front end of the cable armor tube (20) are stripped away to allow a front portion of the cable to bend up to about 90°. A flexible polymer overmold (50) is molded around the front of the armor tube and the rear of the connector and the several inches of wire extending forward of the armor tube. The wire front portions (54) are twisted at least a full turn about the cable axis (44) prior to the overmolding, to reduce wire tension when the front portion of the cable is bent. The overmold has flanges (102) that bottom on one another at a 90° bend of a moderate radius of curvature (R). A wire mesh braiding (80) has a rear end clamped (92) and soldered to the armor and a front end clamped (96) to the connector. An air valve (130) is automatically opened when connectors mate.

18 Claims, 5 Drawing Sheets

ARMORED CABLE CONNECTOR

BACKGROUND OF THE INVENTION

An armor cable is commonly used in difficult environments such as in sewers to resist damage from rats. The armor tube, which is commonly electrically grounded, enables resilient bending only to very large radius of curvature. In some applications, a connector is required for connecting an end of an armor cable to a cabinet assembly, where the cable may be bent up to 90° within a length of less than one foot. Such cables may include up to 216 wires, and it is important to avoid damage to those wires at the outside of such a bend. The armor cable is often pressurized, as with dry air or nitrogen at 15 psi above atmospheric pressure to keep out moisture and prevent corrosion. When a connector at the end of the cable is to be mated to a corresponding connector on the cabinet, such connections are commonly made in difficult environments and it is desirable to provide an indication to the technician when he has fully mated the two connectors.

SUMMARY OF THE INVENTION

In accordance with one embodiment of the present invention, a combination of connector and cable is provided, where the cable has a steel tube around dozens of wires and where the combination must allow for bending of up to 90° within a space with a length of one foot. The armor is stripped away to leave wire front portions that are uncovered by the armor and that extend to contacts of the connector. A flexible polymer overmold is molded around the uncovered wire portions to protect them and allow for bending. The wire front portions are twisted at least one full turn and preferably more, about the cable axis prior to molding of the overmold. The twisting of the wires results in wires near the outside of the bundle, subjected to much less tension when the overmold with wires therein is bent by 90° about a moderate radius of curvature that is less than one foot.

The overmold has a plurality of radially-outward projecting flanges that are closely spaced along the length of the overmold. The flanges are constructed to stack against one another at the inside of a bend of predetermined radius of curvature that is less than the length of the uncovered wire portions and at least about twice the outside diameter of the overmold.

A wire mesh braiding is provided which has a rear end clamped and soldered around the front end of the armor jacket portion and having a front end that is clamped around a body of the connector. Most of the length of the braiding has a diameter about equal to the outside diameter of the armor tube, but the front end of the braiding has a diameter at least 150% as great. A front portion of the braiding is pulled tight into a cone shape prior to the overmolding.

A valve is mounted on the connector to enable pressurization of the cable. The valve includes a valve element such as a ball lying in a passage of the body of the connector and spring biased forwardly. The second connector device on a cabinet has a projecting pipe that pushes the valve member rearwardly during mating to connect pressure in the second connector to the pressure within the cable.

The mating connectors have shells that are threadably connected and that form a latching mechanism that indicates when the shells have been fully threaded together and that resist unlatching. One shell which forms a coupling ring, has a front edge with multiple teeth while the other shell has a rearward projection lying on a beam that can be axially deflected. As a full threading connection is approached, the teeth brush across the projection while flicking it progressively more forcefully.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
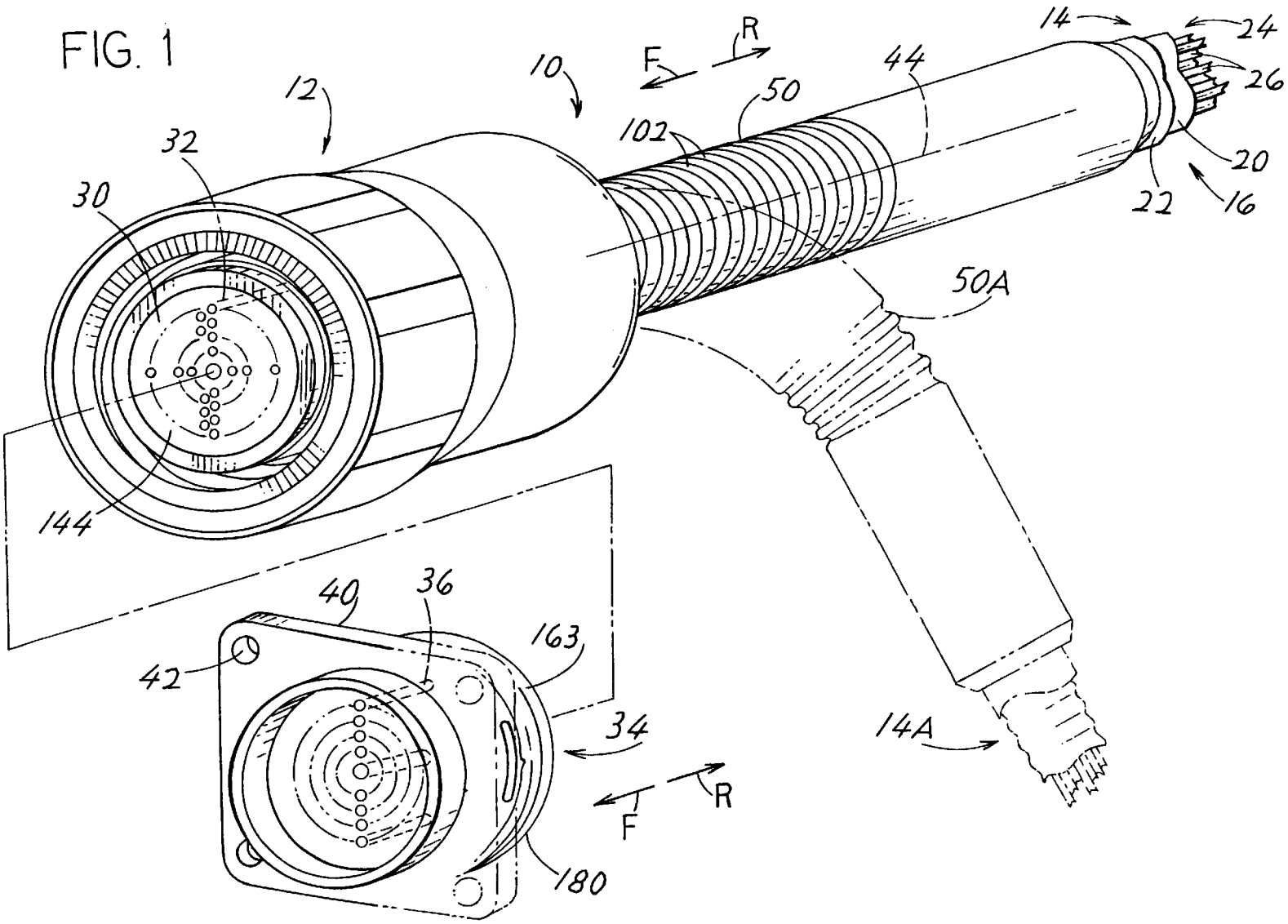
FIG. 1 is an exploded isometric view of a combination connector and cable, and a mating connector device, constructed in accordance with the present invention, and showing the cable both straight and bent.

FIG. 1 illustrates a combination 10 of a connector 12 and cable 14. The cable 14 includes a jacket assembly 16 comprising an armor tube 20 of a metal such as steel and a rubber-like covering 22. A bundle 24 of numerous wires 26 lies within the jacket assembly. The connector 12 includes a body 28 with an insulative body part 30 that holds numerous socket contacts 32 with each contact being connected to the front end of one of the wires. The connector 12 is designed to mate with a second connector or connector device 34 that has numerous pin contacts 36. The connector device 34 has a flange 40 with holes 42 for mounting on a cabinet.

The steel armor tube 20 of the cable has undulations in its diameter that permit it to be bent. However, the armor tube can be resiliently bent only to a large radius of curvature which is about forty times its outside diameter without assurance of no damage to the armor tube. In the case of an armor tube of one inch diameter, this results in a requirement of at least twenty inches in a cabinet structure to account for a 90° bend. Many cabinet assemblies require that the cable be bent by 90° within a space of less than one foot length.

FIG. 1 shows that the combination 10 includes an overmold 50 that is flexible and that allows the wires to be bent to a configuration such as with the overmold at 50A, where the cable at 14A extends 90° from its straight position 14. In the straight cable positions, the axis 44 of the cable is straight. That is, while the cable initially extends in Front F and rear R directions, it can be bent 90°.

Figure 2:
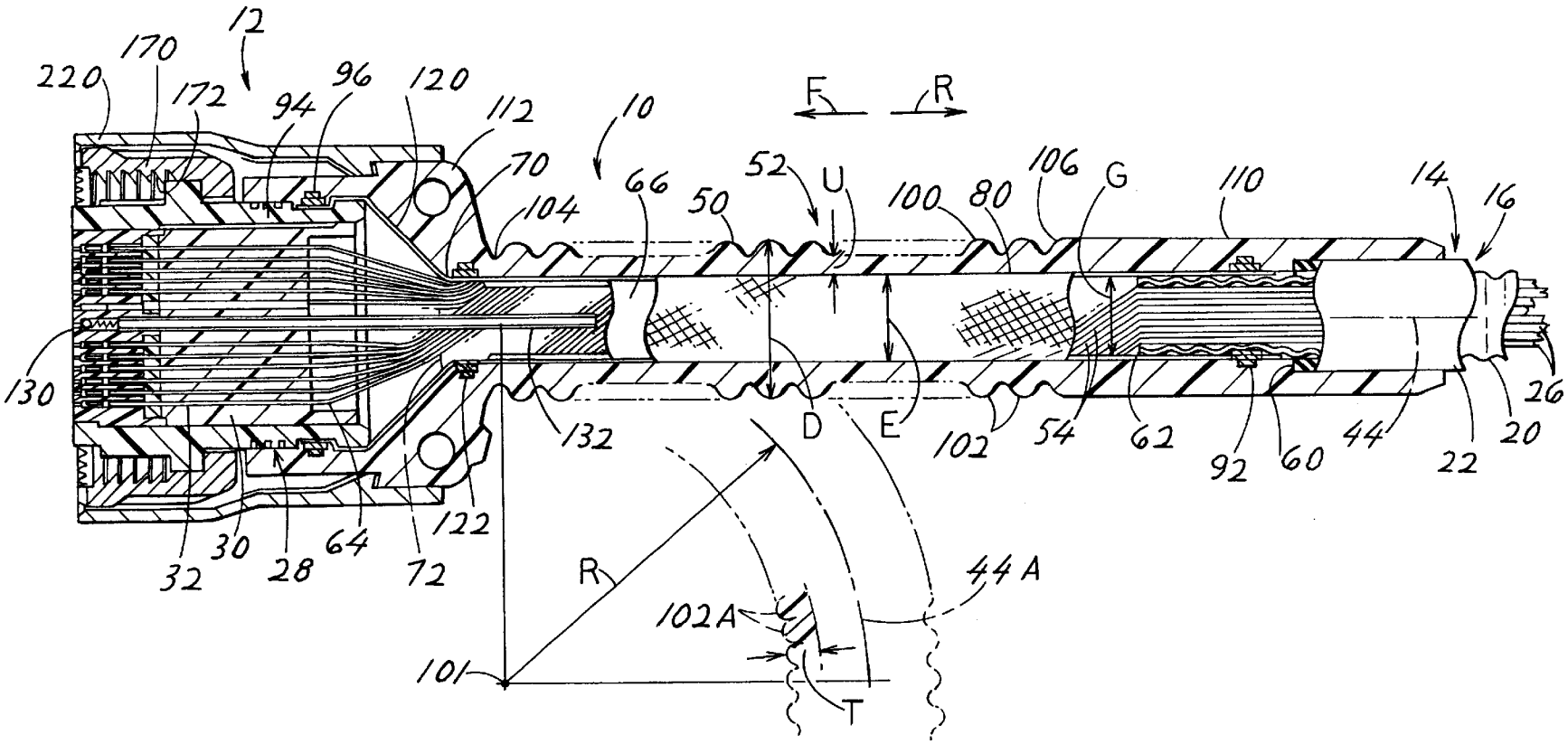
FIG. 2 a sectional view of the combination of connector and cable of FIG. 1, with a 90° bend also indicated.
Figure 3:
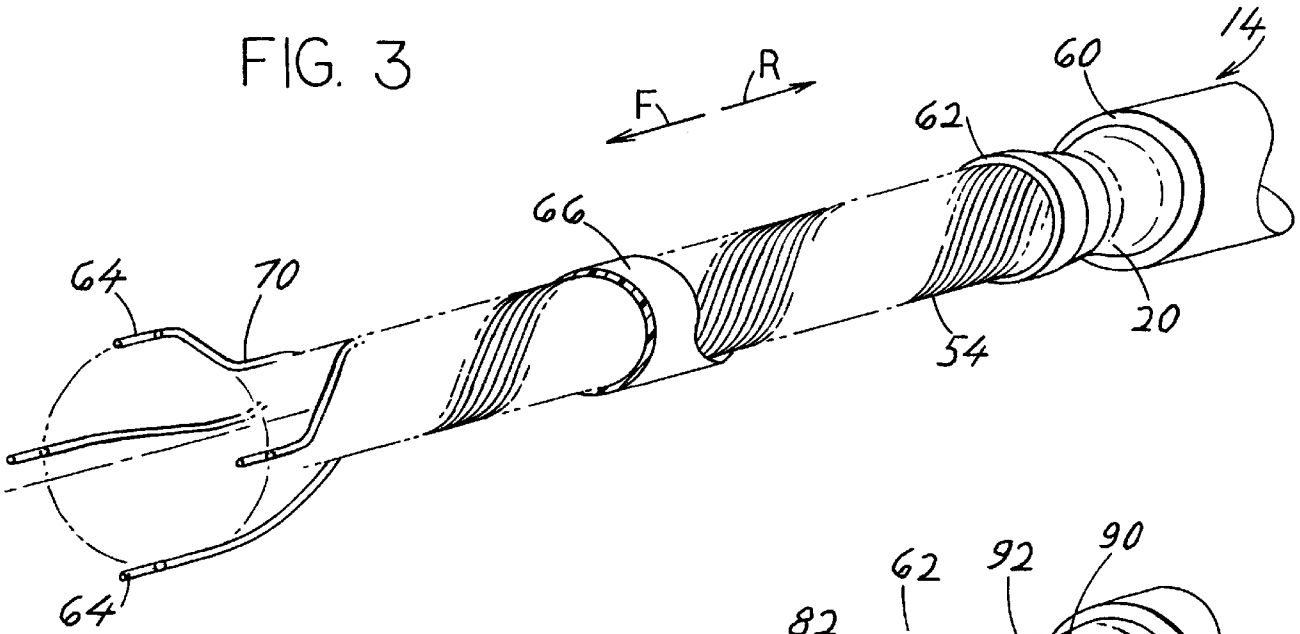
FIG. 3 is an isometric representation of only the cable of FIG. 2, showing the uncovered wire bundle after it has been twisted.

FIG. 2 illustrate details of the combination 10 of the connector 12 and cable 14. A flexible region 52 which extends between the front end of the cable jacket and the connector, includes uncovered wire front portions 54 that are not surrounded by the jacket assembly 14. This is accomplished by cutting away the polymer sleeve 22 of the jacket to leave its front edge at 60, and by cutting away the metal armor tube 20 to leave its front edge at 62. After the polymer sleeve 22 and armor tube 20 have been trimmed, front ends 64 of the wires are connected to the contacts 32 of the connector. Then, the wire bundle along the uncovered wire front portion 54, is twisted about the cable axis 44 by at least a full turn of 360°, and preferably by three turns. FIG. 3 shows the wires twisted by three turns. After the uncovered wire, or uncovered wire bundle, is twisted by three turns, it is covered by a compressing layer 66. Such compressing layer can be a layer of tape wrapped in multiple turns around the twisted wire bundle to compress it and hold its largely cylindrical shape. An alternative, which applicant prefers, is a shrink wrap tube which is a large tube slipped over the twisted wire bundle and then heated to shrink the tube to compress the portion between the front end 62 of the armor tube and wire locations at 70 which are spaced perhaps an inch or two rearward R of the front ends 64 of the wires that connect to contacts of the connector. Thus, the shrink tube has a front end at 72 in FIG. 2.

The reason for twisting the wire bundle is to avoid damage to the wire when the bundle is bent by perhaps 90° about a radius of curvature of perhaps four inches. During such a bend, the portions of the wires near the outside of the bend undergo tension that tends to elongate them, while the wire portions at the inside of the bend tend to undergo compression. The tension could cause breakage of wires at the outside of the bend. However, with twisting, the portions of the wires at the outside of the bend do not extend parallel to the outside of the bend, but extend in a helix. As a result, at the outside of the bend, the wires tend to separate from one another rather than being placed under high stress and possibly breaking. Although a twist of at least 360° is preferred, a twist of the wire bundle of at least one-half or three-quarters turn about the cable axis 44 provides some protection against tension damage.

Figure 4:
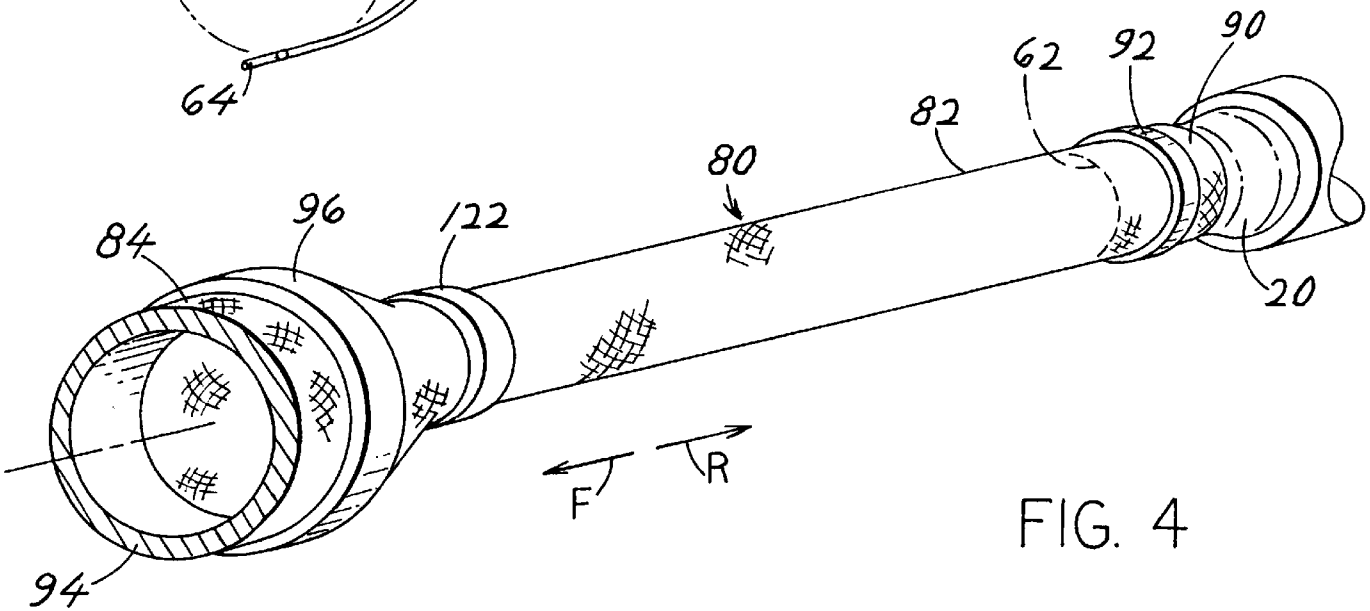
FIG. 4 is an isometric view of a wire mesh braiding, shown clamped to the armor tube of the cable and clamped to the connector.

After the bundle of wires is twisted and a compressing layer is applied, an electrically conductive wire mesh braiding, shown in FIG. 4 at 80, is applied around the front portion of the cable, including the uncovered wire front portions 54. The braiding has a tubular rear portion 82 of about the same diameter as that of the armor tube 20, and having a length in the front and rear directions F, R that is a plurality of times its diameter. The braiding has a front portion 84 of a diameter much greater than that of the tubular rear portion 82, to surround the rear of the connector body. The rear end 90 of the braiding is mechanically and electrically connected to the armor tube 20, by a clamp 92 that clamps the braiding around the armor tube. In addition, the clamp 92 is soldered to the braiding rear end 90 and to the armor tube 20 through holes in the braiding. The front part of the braiding is mechanically connected to an outer body part 94 that surrounds the inner body part 30, by a clamp 96. It is noted that one of the contacts 32 is a grounded contact that is connected to the front end of the braiding. The wire mesh braiding provides for a grounding connection and EMI (Electro Magnetic Interference) protection that otherwise would be provided by the armor tube 20, except that the braiding 80 can undergo resilient bending about a smaller radius of curvature.

After the braiding has been clamped in place, the arrangement of braiding, around a compressed layer which surrounds the twisted bundle of wires, is overmolded by the polymer overmold 50, as shown in FIG. 2. The polymer overmold has an undulating middle or bendable region 100 that includes a plurality of axially-spaced flanges 102 that project radially outwardly with respect to the cable axis 44. The flanges are constructed to stack on one another, as shown at 102A, when the bendable region 100 is bent about a radius of curvature R by 90°. When the overmold is bent at radius R, the length of the bent region of the overmold, along the bent cable axis 44A, equals its length between locations 104, 106. If the length between locations 104, 106 is ten inches, then the radius of curvature R is about 6 inches. When the flanges are stacked as at 102A, any further bending of the bendable region encounters much higher resistance, because the thickness T of the overmold to be further bent is twice as great as the initial thickness U between flanges. This prevents a "sharp" bend, such as a 360° bend about a radius of curvature less than the overmold diameter which can result in a "kink", or permanent bend, in the cable.

The overmold has a rear portion 110 that is about twice the thickness U of the overmold at the radially inner ends of the flanges, so the rear portion 110 is much stiffer than the bendable region 100. The front part 112 of the overmold is of much greater diameter to fit over the insulating body 30, body part 94 and clamp 96.

It should be noted that when the braiding 80 is installed and the combination is placed in a mold, the braiding is placed under tension to form a conical front braiding region 120 extending between the largely cylindrical small diameter rear portion and the larger diameter cylindrical front portion. A clamp 122 prevents expansion of the wire bundle at the rear of the conical region. The two clamps 96, 122 maintain the tension. The tension assures that the braiding will be in the position that it tends to occupy after the combination is completed and a large rearward force is applied to the cable, with the conical region 120 being in the best configuration to take such tension force.

Figure 5:
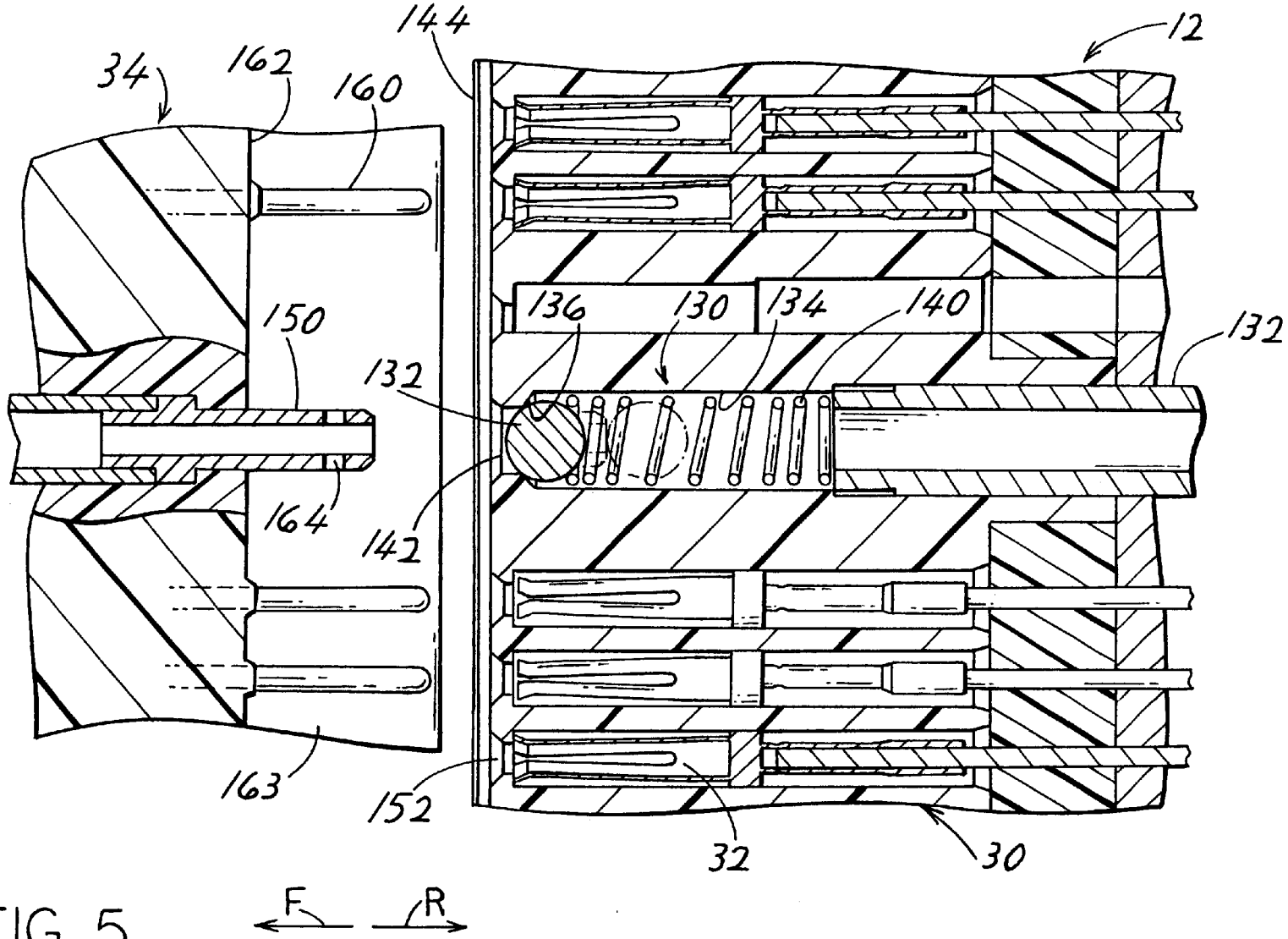
FIG. 5 is an exploded sectional view showing the front mating end of the connector and the mating end of the connector device of FIG. 1, as they closely approach one another for mating, to show the pressured gas valve.

The cable is designed to hold pressured gas such as dry air or nitrogen, at a pressure such as one atmosphere. This helps to keep out moisture and corrosive chemicals that might otherwise leak in through a damaged portion of the armor tube. FIG. 2 shows a valve 130 at the front end of the connector, and a tube 132 that extends rearwardly from the valve to the middle of the cable diameter, to carry such compressed gas into or out of the bundle of wires that lies within the overmold or jacket assembly of a cable. FIG. 5 shows details of the valve 130. The valve includes a valve element 132 in the form of a ball that lies within a passage 134. The valve passage is shown formed in the body 30 of the connector, although it could be formed by a separate metal tube within the rest of the plastic body. The valve passage forms a seat 136, and a spring 140 biases the valve member forwardly against the seat to stop the escape of pressured gas from the cable. An entrance 142 extending into the mating face 144, or surface of the connector 12, is designed to receive a pipe 150 on the mating connector device 34. It is noted that the contacts 32 of the connector 12 are socket contacts and that the connector body forms leadins 152 for guiding pins into the socket contacts. The mating connector 34 has pin contacts 160 that project from a mating face 162, or surface of the connector device for insertion into the socket contacts. The connector device has a peripheral wall 163 that surrounds the pins 160 and tube 150 to protect their rear ends.

As the connectors approach each other, the pin contacts 160 enter the socket contacts 32, and the pipe 150 passes through the entrance 152 into the valve passage 134. The pipe pushes back the valve element to position 132B. At full insertion, holes 164 in the pipe communicate with the valve passage 134, so pressured gas can flow from the pipe 150 into the valve passage 134, and through the tube 132 into the inside of the armor tube of the cable, or vice versa. In some cases, an end of the cable opposite the connector 12, is connected to another cabinet with a source of pressured gas. The valve 130 remains closed to keep in the pressured gas, until the connectors are mated, to minimize loss of gas. It is noted that it is possible to form the pipe 150 on the connector and, where desirable, provide a separate shutoff valve to prevent loss of gas in the cable until the connector is mated with another connector such as one on a cabinet.

Figure 7:
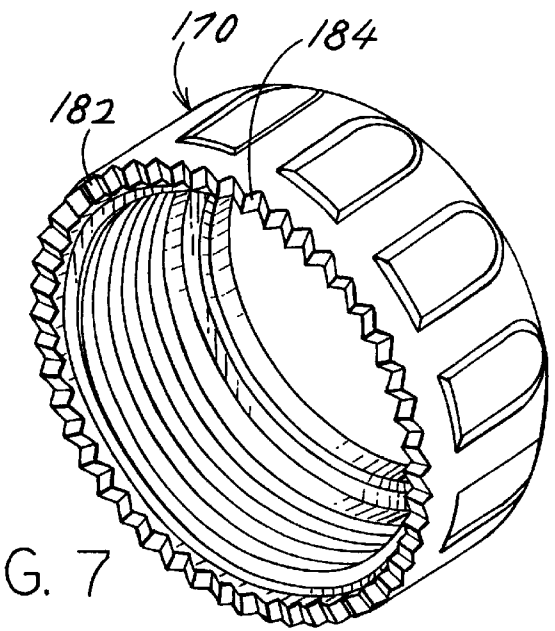
FIG. 7 is an isometric view of the connector shell of FIG. 6.
Figure 6:
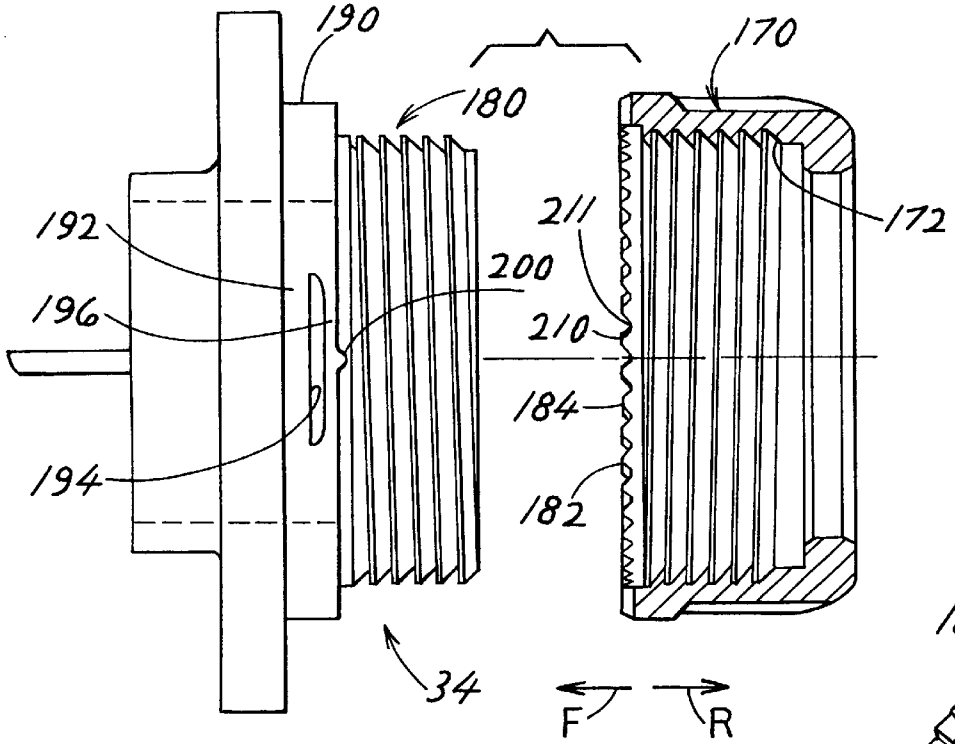
FIG. 6 is an exploded side view of shells of the connector and connector device of FIG. 1, with the shell of the connector shown in section.

FIG. 2 shows that the connector 12 includes a coupling ring in the form of a shell 170 with a threaded inside 172 that can threadable engage the threaded outside of the shell of the mating connector device. FIGS. 6 and 7 show the coupling ring shell 170 and the mating shell 180 of the connecting device 34. The coupling ring shell 170 forms a ring 182 of teeth 184. The teeth are closely spaced, with the particular ring 182 having thirty-eight teeth at a pitch angle of about 9.5°. The mating shell 180 includes a second cylinder 190 having a main part 192 and having a circumferentially-extending slot 194 forming a beam 196. The beam has a projection 200 that projects rearwardly R from the rest of the beam 196. The opposite ends of the beam are connected to the main part 192.

As the coupling ring shell 170 is threaded onto the shell 180, the teeth 184 approach the projection 200. Initially, the addendum, or axially most forward end 210 of a tooth brushes by the projection 200. The addendum of each tooth lies axially forward of the tooth dedendum, or tooth bottom 211. The next tooth then can be moved circumferentially across the projection 200, but with moderate resistance, and with a "click" sound being generated. A technician who is turning the coupling ring shell 170 (or the outer cylinder 220 shown in FIG. 2), can feel the sudden increased resistance followed by a sudden decrease in resistance, to turning, as a tooth brushes by the projection. In most cases, the technician will turn the coupling ring shell until perhaps one or two additional teeth pass by the projection, at which time there is a high resistance to further turning. The "click" sound and click tactile feedback transmitted to the technician who is turning the coupling ring, informs that technician that the shells of the two connectors have been properly mated and that the connector has been turned sufficiently for full installation. It is desirable that the teeth 184 be angularly spaced by no more than about 15°, so a plurality of teeth can brush pass the projection as the coupling ring shell approaches full threaded connection. With a fifteen degree pitch, there are at least twenty-four teeth per full turn. The number of teeth that will brush by before there is high resistance to further turning, also depends upon the thread pitch and the resilience of the beam 196.

In a combination of the construction shown in FIG. 2 that applicant has designed, the cable has 216 wires and the connector has 216 corresponding contacts. The armor tube has an outside diameter G of one inch, the compression layer 66 has an outside diameter of about one inch, the wire mesh braiding has an outside diameter E of about one inch, and the overmold has an outside diameter D of two inches. That is, the radially outer ends of the flanges lie on an imaginary cylinder of two inches diameter. The bendable region 100 of the overmold has a length of about ten inches between its opposite ends 104, 106. The braiding has a diameter inside the clamp 96 of 3.25 inches. The wire is twisted by three full turns between one end of the uncovered wire portion at the front end 62 of the armor tube and the front end of the compression layer at 70.

Thus, the invention provides a combination of connector and cable with a rugged and flexible transition between the cable and connector. A flexible polymer overmold is molded around uncovered wire front portions, with the overmold being elongated along the axis of the cable and being bendable. The uncovered wire front portions are twisted at least one-half turn and preferably at least one full turn about the cable axis, and with the overmold being molded around the wire front portions after they have been twisted. The overmold has a plurality of radially-outwardly projecting flanges which are constructed to stack one-against-another at the inside of a bend of the overmold, where the bend has a radius of curvature that is at least twice the outside diameter of the overmold. The uncovered wire portions are surrounded by an electrically conductive wire mesh braiding having about the same diameter as the armor tube along most of its length, and having an enlarged front end that is clamped to a metal ground cylinder lying around the body. A transition in diameter of a front portion of the braiding, is achieved by pulling the braiding into a conical shape prior to the overmolding. Front and rear ends of the braiding are clamped in place. A valve for passing pressure gas into or out of a cable, has a valve element that is pushed rearwardly by a pipe on the mating connector device to pass air between the connectors. A pair of shells, or cylinders, on the connector and connector device that are threaded together during connector mating, are constructed with one having a beam with a rearward projection and with the other having a shell with a ring of teeth that approach the projection to provide audible and tactile feedback.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a connector and a cable, where said cable has a cable axis and said cable includes a jacket assembly and a plurality of wires lying within said jacket assembly, with a front portion of said jacket assembly removed to expose wire front portions, wherein each wire front portion has a front end, and said connector includes a primarily insulative body and a plurality of contacts mounted in said body, each uncovered wire front portion extending to one of said contacts and each contact connected to said front end of one of said wire front portions, including:

a flexible polymer overmold that is molded around most of the lengths of said wire front portions, said overmold being elongated parallel to said cable axis and being bendable;

said wire front portions are twisted at least one-half turn about said cable axis, with said overmold being molded about said wire front portions after said wire front portions have been twisted.

2. The combination described in claim 1 wherein:

said overmold has a bendable region forming a plurality of radially outwardly projecting flanges with radially outer ends that lie on an imaginary cylinder of predetermined cylinder diameter;

said flanges are constructed to stack one-against-another at the inside of a bend along said bendable region, where the bend has a radius of curvature that is at least about twice said cylinder diameter, but no more than ten times said cylinder diameter.

3. The combination described in claim 1 wherein:

said plurality of wires is twisted by at least one complete turn.

4. The combination described in claim 1 wherein:

said plurality of wires includes a bundle of at least two dozen wires extending along said cable axis, and said bundle is twisted by at least about two complete turn about said cable axis, whereby to avoid tensile damage to wire portions that lie near a radially outer portion of said bundle when said bundle is bent about an axis that is perpendicular to said cable axis.

5. The combination described in claim 1 wherein said connector has a mating end and Including a second connector device which has a mating end that is mateable to said connector by moving said connector device along a connector axis toward said connector, with said connector and connector device each having a shell with one of said shells being a coupling ring shell that is rotatable, and where one shell has an external thread and the other has an internal thread and threadably receives the other shell, including a latching mechanism that resists unthreading of said shells and that indicates when the shells are being fully mated, wherein:

a first of said shells includes a first cylinder with a front edge having multiple teeth angled apart about said axis, with said teeth having teeth dedendums and having teeth addendums spaced forwardly of said teeth dedendums;

a second of said connectors includes a second cylinder having a main part and having a circumferentially-extending slot forming a circumferentially-extending beam lying rearward of the slot, said beam having circumferentially spaced opposite ends each merging with said main part and said beam forming a projection that projects rearwardly and that is positioned to engage said teeth as said shells are threaded together.

6. The combination described in claim 1 wherein said jacket includes a metal armor tube, and said connector has a metal ground cylinder that extends around said contacts and that has a diameter that is greater than the outside diameter of said armor tube, including:

an electrically conductive wire mesh braiding having a tubular rear portion of a first diameter that is about the same as an outside diameter of said armor tube and having a length that is a plurality of times said first diameter, said braiding having a front portion with a diameter that is at least 150% of said first diameter, with a rear end of said braiding being mechanically and electrically fixed to said armor tube and with a front end of said braiding being fixed to said connector.

7. The combination described in claim 6 wherein:

said braiding has a transition region lying between a front end of said braiding rear portion and said braiding front portion, and including first and second clamps with said first clamp fixing said braiding front portion to said connector and with said second clamp fixed to said front end of said braiding rear portion, with said braiding pulled into a conical shape along said transition region.

8. The combination described in claim 6 including:

a compressing layer of insulative material which tightly surrounds said twisted wire front portions, with said braiding surround said compressing layer.

9. The combination described in claim 1 wherein said cable contains gas at a pressure above atomospheric pressure and said connector has a connector mating face with said contacts lying thereat, and including a mating connector device with a device mating face and with contact devices that are accessible at said device mating face and that are mateable to said contacts, said contacts and contact devices comprising pins and sockets, including:

a valve mounted on said connector, said valve having a valve element and said body forming a passage that surrounds said valve element and a seat lying forward of said valve element, said valve element being spring biased against said seat to close said valve, and including a tube extending rearwardly from said passage to at least said wire front ends;

said passage having an entrance lying at said connector mating face and leading to said passage;

said connector device having a pipe that projects rearwardly from device mating face and which is of a slightly smaller diameter than said entrance to project through said entrance into said passage and move said valve element rearwardly away from said seat, said pipe having side walls with a hole that passes pressured air to pass gas between said pipe and said passage;

said pin and socket elements being positioned to mate as said pipe passes through said entrance during mating of said connectors.

10. The combination described in claim 9 wherein:

said contacts of said connector are socket contacts that are recessed in said connector mating face, and said contact devices are pin contacts that project rearward of said device mating face, said connector device having a peripheral wall that projects rearward of said device mating face and that surrounds rear ends of said pin contacts and a rear end of said pipe.

11. The combination of a connector and a cable, wherein said cable has a cable axis and said cable includes a metal armor tube having an outside armor tube diameter and having an armor tube front end, and at least one wire lying within said armor tube, and wherein said connector includes a body and at least one contact lying in said body and connected to said wire, said body having an outside diameter at least 150% as great as said armor tube diameter, including:

an electrically conductive wire mesh braiding having a tubular rear portion of about said armor tube diameter and mechanically and electrically attached to said armor tube front end;

said braiding having a tubular front portion that is connected to said connector;

said braiding tubular front portion lies around said body, and said braiding has a portion that has been tensioned into a conical portion extending between said front and rear portions, and including a clamp lying around said braiding at a rear end of said conical portion.

12. The combination described in claim 11 wherein:

said at least one wire is flexible so it can be bent by at least 90° along a length between a front end of said armor tube and a rear end of said body;

said braiding tubular rear portion has a length that is at least twice its diameter; and including a polymer overmold that is molded around said braiding, around said armor tube rear portion and around a portion of said metal ring, said overmold having a flexible overmold portion that extends forwardly from said armor tube front end by at least twice an outside diameter of said flexible over mold portions, said flexible overmold portion being resiliently bendable by at least 90° about a radius that is four times said outside diameter of said flexible overmold portion.

13. The combination describe claim 11 wherein:

said at least one wire includes a bundle of at least two dozen wires extending along a bundle axis, and said bundle is twisted by at least one complete turn about said bundle axis, whereby to reduce the possibility of tension damage to one of said wires when said bundle is bent 90° about an axis that is perpendicular to said bundle axis.

14. The combination of a connector and a cable, where said cable has a cable axis, a bundle of wires extending along said axis and a protective jacket assembly lying around said wires with a length of said jacket being striped away to leave front uncovered wire portions extending forward of a front end of said jacket, and where said connector has an insulative body and a plurality of contacts lying in said body and connected to front ends of said wires, comprising:

a polymer overmold that is molded around a portion of said connector along a majority of the length of said uncovered wire portions, and around a portion of said jacket assembly;

said overmold has a bendable region, said bendable region forming a plurality of radially outwardly projecting flanges with radially outer ends that lie on an imaginary cylinder of predetermined cylinder diameter;

said flanges are constructed to stack one-against-another at the inside of a 90° bend that extends along said bendable region and about a bend axis that is perpendicular to said cable axis when said cable is unbent, where the bend has a radius of curvature that is between about twice and six times said cylinder diameter.

15. The combination of a connector and a cable, where said cable includes a gas tight metal armor tube and a plurality of wires lying within said armor tube, and said connector includes a body with an axis and a plurality of contacts mounted in said body and connected to said wires, said body having a front mating face and said contacts having mating front ends that are accessible at said mating face, wherein:

said body forms a passage extending parallel to said axis and said connector includes a valve having a moveable valve element lying in said passage, said passage having a seat lying forward of said valve element and said valve element being spring biased forwardly against said seat to close the valve, said body having an entrance hole extending from said mating face and through said seat to receive a projecting pipe that moves said valve element rearwardly;

said passage extends to the rear of said body and communicates with the inside of said armor tube, whereby to enable simultaneous electrical and pressured gas connection of the connector with a mating connector device.

16. The combination described in claim 15 wherein:

said armor tube has a front end and said wires extend forwardly beyond said armor tube front end; and including a flexible polymer overmold that has an overmold rear portion that is molded around said armor tube front end, an overmold front portion molded around at least a rear portion of said body, and an overmold middle portion that extends between said overmold front and rear portions and that is gas tight, said overmold rear, front end middle portions being integral.

17. The combination described in claim 15 wherein:

said contacts are socket contacts; and including a connector device that is mateable with said connector, said connector device having a rear mating face surface and a plurality of pin contacts projecting rearwardly from said rear mating face surface for insertion into said socket contacts;

said connector device has a pipe that projects rearwardly from said mating face surface and which is of a slightly smaller diameter than said entrance to project through said entrance hole into said passage and move said valve element rearwardly away from said seat, said pipe having side walls with a hole that passes pressured gas to pass gas between said passage and the inside of said pipe.

18. A method for connecting a cable to a connector, where said cable has a plurality of wires lying within a jacket that includes a metal conductor, and where said connector includes a body, and a plurality of contacts lying in said body, comprising:

stripping away said jacket to leave uncovered front wire end portions, and connecting front ends of said uncovered wire end portions to said contacts of said connector;

molding an overmold around said body, around a front end of said metal tubular conductor of said jacket and around a majority of the length of said uncovered wire end portions;

said metal conductor of said jacket is a metal tube and said connector body has a diameter that is more than 150% of the diameter of said metal tube; and including applying a tubular wire mesh braiding with an enlarged front end around said front wire end portions, including clamping a rear end of said braiding around said metal tube, and clamping a front portion of said braiding around said body.

* * * * *